US007836537B1

(12) United States Patent
Kumar

(10) Patent No.: US 7,836,537 B1
(45) Date of Patent: Nov. 23, 2010

(54) TOOTHBRUSH WITH INDEPENDENTLY MOBILE BRISTLE GROUPS FOR VERTICAL BRUSHING OF TEETH

(76) Inventor: Devakumaran J. Kumar, 2124 Lawrence La., Apt. 230, Grand Island, NE (US) 68803

( * ) Notice: Subject to any disclaimer, the term of this patent is extended or adjusted under 35 U.S.C. 154(b) by 358 days.

(21) Appl. No.: 12/215,423

(22) Filed: Jun. 27, 2008

(51) Int. Cl.
*A46B 7/06* (2006.01)
*A46B 9/04* (2006.01)
*A46B 9/10* (2006.01)

(52) U.S. Cl. ..... 15/22.1; 15/22.2; 15/167.1; 15/201

(58) Field of Classification Search ..... 15/22.1, 15/22.2, 167.1, 201
See application file for complete search history.

(56) References Cited

U.S. PATENT DOCUMENTS 2,882,544 A * 4/1959 Hadidian ..... 15/167.1
2,935,755 A * 5/1960 Leira et al. ..... 15/167.1
3,683,442 A * 8/1972 Holly ..... 15/167.1
4,694,844 A * 9/1987 Berl et al. ..... 15/167.1
5,184,368 A * 2/1993 Holland ..... 15/167.1
5,481,775 A * 1/1996 Gentile et al. ..... 15/22.1
5,524,319 A * 6/1996 Avidor ..... 15/167.1
2004/0128784 A1* 7/2004 Ben-Ari ..... 15/167.1

FOREIGN PATENT DOCUMENTS

FR 2616306 * 12/1988

* cited by examiner

*Primary Examiner*—Mark Spisich
(74) *Attorney, Agent, or Firm*—Tipton L. Randall

(57) ABSTRACT

A toothbrush with independently mobile bristles comprises a toothbrush body with a handle section, a head section and a neck section, with a long axis there through. A plurality of individual, linear slots extends from a top surface of the head section and terminates there within. The individual slots are angled to the long axis of the toothbrush body. A bristle assembly is movably positioned in each slot of the head section with a bristle group extending exterior to the top surface thereof. When brushing teeth, movement of the toothbrush body in a first direction, parallel with the long axis thereof, causes movement of the bristle assemblies in a direction essentially perpendicular to the long axis of the toothbrush body. Movement of the toothbrush body in the opposite direction causes movement of the bristle assemblies in an opposite direction, also essentially perpendicular to the long axis of the toothbrush body.

19 Claims, 7 Drawing Sheets

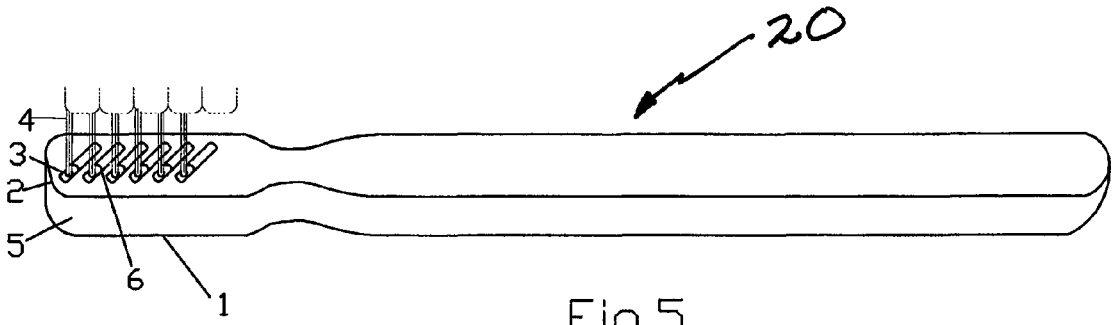
Fig.5
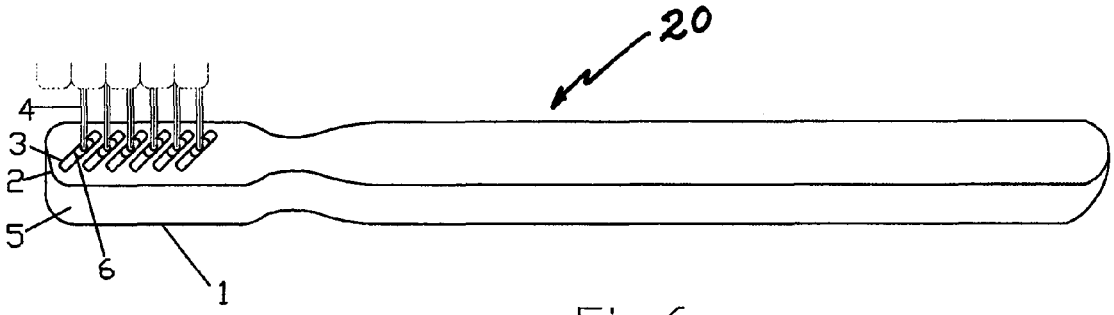
Fig.6
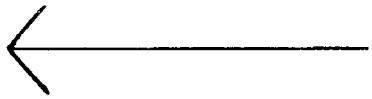

TOOTHBRUSH WITH INDEPENDENTLY MOBILE BRISTLE GROUPS FOR VERTICAL BRUSHING OF TEETH

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a toothbrush and, more particularly, to a toothbrush with mobile bristle groups and, most particularly, to a toothbrush with mobile bristle groups for vertical brushing of teeth.

2. Background Information

The toothbrush is a commonly known and used object. The toothbrush consists of a handle and a head that holds the bristle groups for cleaning teeth. The present invention provides an improved toothbrush that is different in that the bristle groups are freely and controllably mobile instead of being fixed by their bases to the head of the toothbrush.

Most individuals brush their teeth by moving the toothbrush horizontally, across the teeth. The dentists advise that the toothbrush should be moved vertically to clean the teeth and the space between neighboring teeth properly and hygienically. Despite the advice of the dentists and the person's intention to follow that advice, individuals inevitably move the brush horizontally. The vertical brushing toothbrush allows users to follow the habit of brushing horizontally; that is moving the brush horizontally, while the bristle groups move vertically, almost perpendicular to the direction of movement of the brush. The vertical brushing toothbrush brings to life the decades old dental concept of brushing the teeth vertically so as to provide maximum cleaning of the teeth.

It is not ergonomic or convenient to use the human arm to move the toothbrush vertically. This requires flicking the wrist up and down while holding the elbow still. This movement is performed by the smaller muscles of the forearm that move the wrist. Whereas, movement of the toothbrush horizontally, using the sizable and powerful biceps and triceps, the user is able to put some power into those movements, and this intrinsically makes the brushing process more convenient and easier. The vertical brushing toothbrush lets users brush their teeth with horizontal movements of the brush, while still achieving maximum cleaning, because the bristles move vertically, almost perpendicular to the direction of the brush.

According to the present invention, a toothbrush is provided that has means for bristle groups which move almost vertically. The vertical brushing toothbrush does not use batteries or electricity. The effective cleaning is purely the result of the bristles moving almost perpendicular to the horizontal direction of movement of the brush. The absence of electronic parts makes the novel toothbrush cheap to manufacture, as compared to toothbrushes that offer enhanced cleaning based on a motorized head that moves the bristles. Besides, a motorized toothbrush interferes with the natural act of brushing teeth. The absence of electrical parts makes the present invention more environmentally friendly.

The vertical brushing toothbrush uses fewer bristles than ordinary toothbrushes. The hollow spaces inside also reduce the amount of plastic or other material required for manufacture. Regardless of the material used for manufacture, this can be expected to lower cost of manufacture. Suitable materials for manufacturing the toothbrush include commonly used material, such as polypropylene.

In ordinary tooth brushes, only the tip of the bristles can move since the base of each bristle is fixed. The vertical brushing toothbrush is unique in that each group of bristles moves in its entirety. Each bristle group is mounted on a moveable sliding base, which enables easy gliding movements, almost perpendicular to the horizontal direction of movement of the brush.

The vertical brushing toothbrush is a fundamentally different type of toothbrush, where the bristle clusters are on mobile bases and are independently mobile. This gives the act of brushing teeth a new flexibility that is lacking in all previous toothbrushes.

SUMMARY OF THE INVENTION

The invention is directed to a toothbrush with independently mobile bristles. The toothbrush comprises a toothbrush body, including a linear handle section connected to a head section via a neck section. The toothbrush body has a long axis there through. A plurality of individual, linear slots extends from a top surface of the head section and terminates there within. The individual slots are oriented at an angle to the long axis of the toothbrush body. A plurality of bristle assemblies, each including a linear bristle holder with a bristle group extending from a first end of the bristle holder, is present. At least one bristle assembly is movably positioned in each linear slot of the head section, with the bristle group extending exterior to the top surface thereof. In use, placing the bristle groups of the toothbrush in contact with the teeth of an individual and movement of the toothbrush body in a first direction, parallel with the long axis thereof, causes movement of the bristle assemblies within the slots in a direction essentially perpendicular to the long axis of the toothbrush body. Movement of the toothbrush body in a second direction, opposite the first direction, causes movement of the bristle assemblies within the slots in an opposite direction, also essentially perpendicular to the long axis of the toothbrush body.

In a preferred embodiment of the invention, the head section of the toothbrush body is a hollow structure and includes a top plate, a bottom plate, and a middle plate positioned in spaced relationship to both the top plate and bottom plate, with the top plate and middle plate including a plurality of aligned, linear slots in register there through.

In a most preferred embodiment of the invention, the linear bristle holder of the bristle assembly is positioned within a linear slot of the middle plate and the bristle group of the bristle assembly is positioned within the aligned linear slot of the top plate. Additionally, the linear bristle holder includes a stabilizer rim at the end thereof from which the bristle group extends, and the stabilizer rim is positioned interior the hollow head section adjacent the top plate, with the stabilizer rim sized to prevent passage of the bristle holder through the linear slot of the top plate. Further, the linear bristle holder includes a base at a second end thereof, with the base in slidable contact with the bottom plate of the hollow head section. The base thus prevents tipping of the linear bristle holder of the bristle assembly within the linear slots of the middle and top plates.

BRIEF DESCRIPTION OF THE DRAWINGS

The invention will now be described by way of non-limiting example only with reference to the figures given herein.

FIG. 5 and FIG. 6 are perspective views of a toothbrush of the present invention, showing movement of the bristle groups in the slanting slots as the brush moves across the surface of teeth.

DESCRIPTION OF THE EMBODIMENTS

| Nomenclature | |
|---|---|
| 1 | Head Section of Toothbrush |
| 2 | Top Plate |
| 3 | Slots in Head Section |
| 4 | Bristle Groups |
| 5 | Side Wall of Head Section |
| 6 | Stabilizing Rim of Bristle Holder |
| 7 | Bristle Holder Body |
| 8 | Base of Bristle Holder |
| 9 | Handle Section of Toothbrush |
| 10 | Middle Plate |
| 11 | Neck Section of Toothbrush |
| 12 | Slots in Middle Plate |
| 13 | Bottom Plate |

-continued

| Nomenclature | |
|---|---|
| 14 | Void in Head Section |
| 15 | Void in Head Section |
| 17 | Bristle Holder Assembly |
| 20 | Body of Toothbrush |
| 25 | Mobile Bristle Toothbrush |
| A | Long Axis of Body of Toothbrush |

Construction

The invention is a toothbrush with independently mobile bristles. The toothbrush comprises a toothbrush body including a linear handle section connected to a head section via a neck section. The toothbrush body has a long axis there through. A plurality of individual, linear slots extends from a top surface of the head section and terminates there within. The individual slots are oriented at an angle to the long axis of the toothbrush body. A plurality of bristle assemblies, each including a linear bristle holder with a bristle group extending from a first end of the bristle holder, is present. At least one bristle assembly is movably positioned in each linear slot of the head section, with the bristle group extending exterior to the top surface thereof. In use, placing the bristle groups of the toothbrush in contact with the teeth of an individual and movement of the toothbrush body in a first direction, parallel with the long axis thereof, causes movement of the bristle assemblies within the slots in a direction essentially perpendicular to the long axis of the toothbrush body. Movement of the toothbrush body in a second direction, opposite the first direction, causes movement of the bristle assemblies within the slots in an opposite direction, also essentially perpendicular to the long axis of the toothbrush body.

Figure 1:
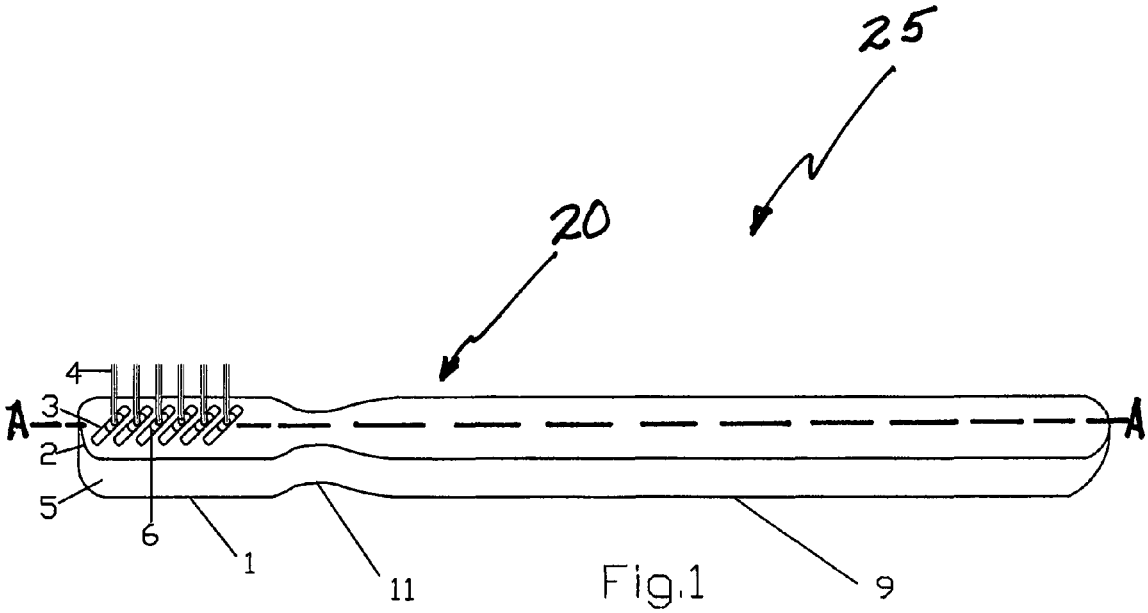
FIG. 1 is a perspective view of a toothbrush of the present invention.

Referring now to FIG. 1, the linear handle section 9 of the mobile bristle toothbrush 25 connects to the neck section 11 of the toothbrush 25, which, in turn, connects to the head section 1 of the toothbrush 25. The linear handle section 9 connected to the head section 1 by the neck section 11 makes up the toothbrush body 20, which has a long axis A there through. The head section 1 of the toothbrush 25 is optionally enclosed by the side wall 5. The top surface 2 of the toothbrush head section 1 includes a plurality of linear, slanted slots 3 that terminate within the head section 1. Preferably, the slanted slots 3 are oriented at an acute angle relative to the long axis A of the toothbrush body 20 and are mutually parallel. The linear, slanted slots 3 provide openings for the bristle groups 4 to emerge and protrude above the top surface 2 of the head section 1. The bristle groups 4 are each mounted in a bristle holder body 7 having an upper stabilizing rim 6 at a first end thereof, and a bristle holder base 8 opposite the bristle group 4 at a second end thereof. The bristle holder body 7 and bristle group 4 comprise the bristle holder assembly 17. The bristle holder's stabilizing rim 6 prevents the bristle holder assembly 17 from falling out through the slanting slots 3 of the head section 1 of the toothbrush 25.

Figure 2:
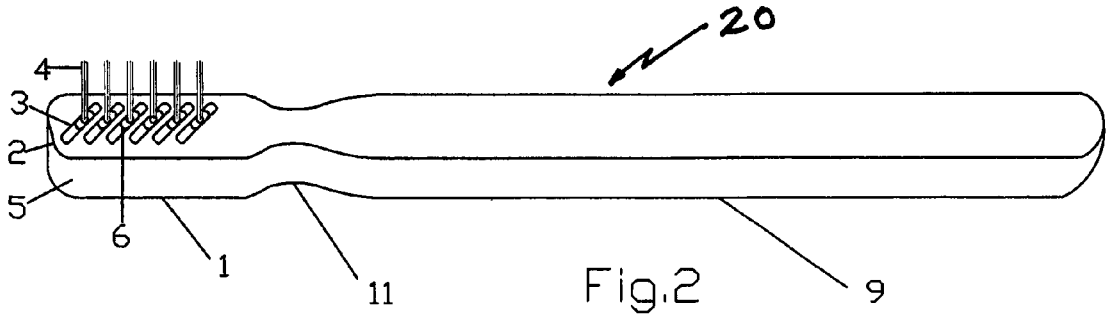
FIG. 2 is a perspective view of a toothbrush of the present invention, showing the bristle groups positioned in the middle of the slanting slots.
Figure 3:
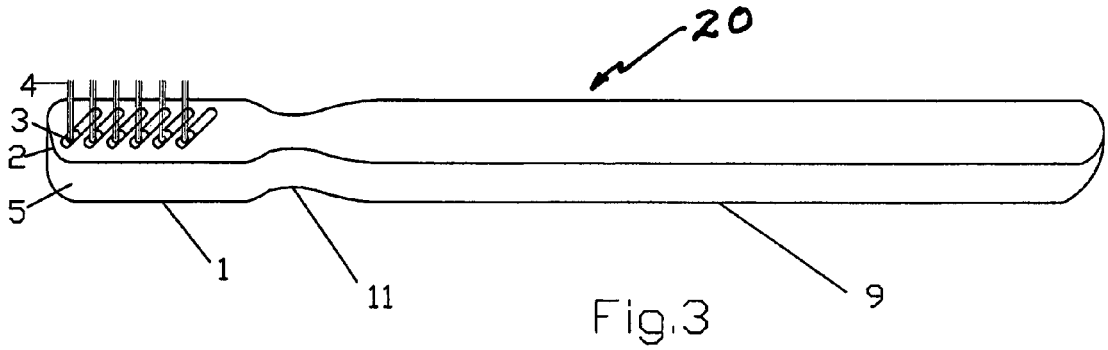
FIG. 3 is a perspective view of a toothbrush of the present invention, showing the bristle groups positioned toward the nearer end of the slanting slots.

Referring now to FIG. 2, the bristle groups 4 are shown positioned in the slanted slots 3 at a position that is mid-position in the slanted slots 3. In FIG. 3, the same bristle groups 4 are seen positioned nearer to the viewer, as they have slid and changed position within the slanted slots 3.

Figure 4:
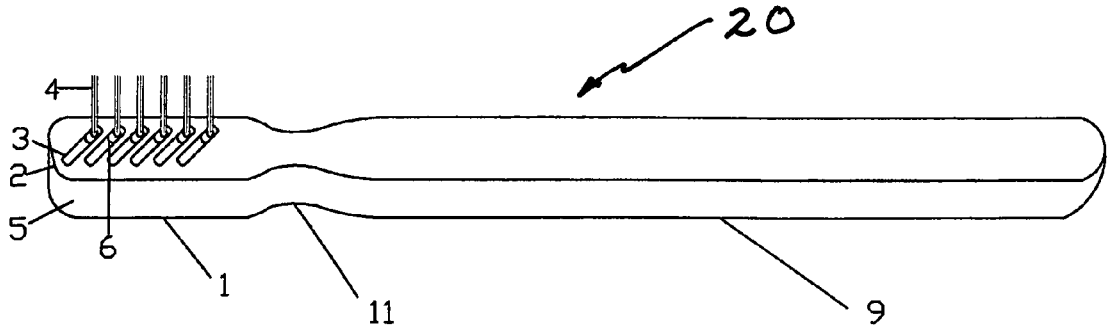
FIG. 4 is a perspective view of a toothbrush of the present invention, showing the bristle groups positioned toward the farther end of the slanting slots.

In FIG. 4, the same bristle groups 4 have changed position by sliding within the confines of the slanted slots 3 and are now located farther away from the viewer. FIG. 2, FIG. 3 and FIG. 4 demonstrate that the bristle groups 4 are able to change position inside the confines of the slanted slots 3 of head section 1. The functionality of the present invention is independently mobile bristle groups 4, and the drawings illustrate how the bristle groups 4 move and change position within the slanted slots 3.

Referring now to FIG. 5, the bristle groups 4 are positioned at one end of the slanted slots 3 of the head section 1. In FIG. 6, as the toothbrush 25 is moved across the surface of the teeth in a direction parallel with the long axis A of the toothbrush body 20 (in the direction of the arrow), the bristle groups 4 are urged to move in a non-parallel direction by virtue of their independent mobility. The slanted slots 3, which are oriented at a non-perpendicular, acute angle to the direction of movement of the body 20 of the toothbrush 25, forces the bristle groups 4 to move along the path of the slanted slots 3. Thus, the bristle groups 4 move in a direction that is essentially perpendicular to the direction of movement of the toothbrush body 20, which moves parallel with the long axis A thereof. On examining these figures, it becomes evident that any horizontal movement of the toothbrush 25 on the surface of teeth provokes a vertical movement of the bristle groups 4, which is the preferred means for thorough cleaning of the teeth, especially the spaces between the teeth.

FIGS. 5 and 6 illustrate the toothbrush 25 with the bristle groups 4 extending vertically upward to contact the upper teeth of an individual. However, movement of the bristle groups 4 in a direction essentially perpendicular to the direction of movement of the toothbrush body 20 occurs regardless of the orientation of the bristle bundles 4, either vertically (up or down) or horizontally, as determined by the user. Thus, the user can brush either the upper or lower teeth or the exterior surfaces of both upper and lower teeth and the bristle bundles 4 move in a direction essentially perpendicular to the direction of movement of the toothbrush body 20.

Figure 7:
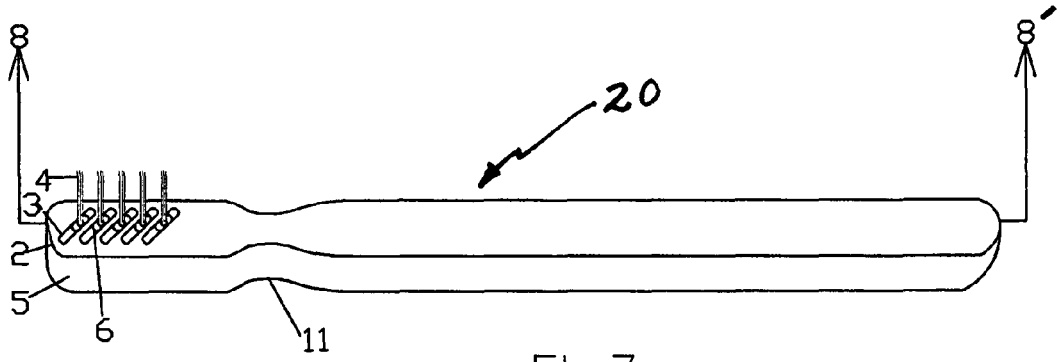
FIG. 7 is another perspective view of a toothbrush of the present invention.
Figure 8:
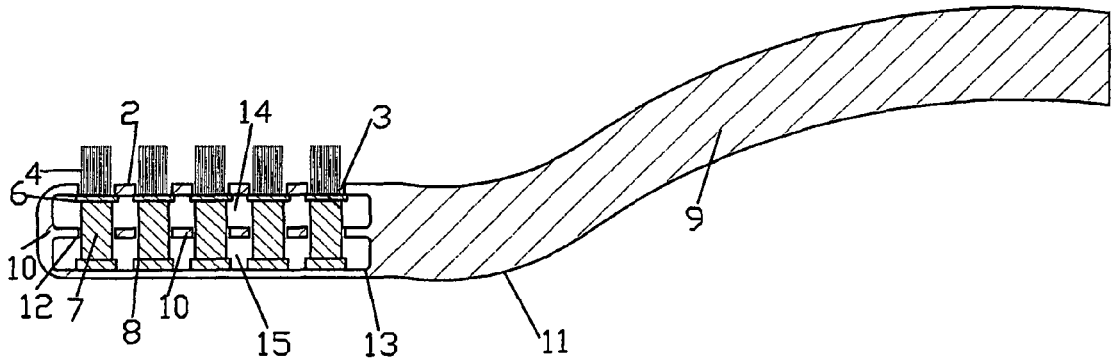
FIG. 8 is a cross sectional view along line 8-8' of FIG. 7, showing the bristle holders inside the head of the toothbrush.

Referring now to FIG. 7 and FIG. 8, the cross-sectional view of FIG. 8 represents the cross section at the location marked by line 8-8' on FIG. 7. This cross-section passes adjacent to the bristle holder assemblies 17, showing their structure. Referring to FIG. 8, the head section 1 of the toothbrush 25 has three plates, with the top plate 2 containing the plurality of slanted slots 3 through which each of the plurality of bristle groups 4 protrude. Each one of the bristle groups 4 is affixed in its own bristle holder assembly 17, which again is present in plurality. Each bristle holder assembly 17 comprises a bristle holder stabilizing rim 6, a bristle holder body 7 and a bristle holder sliding base 8. The bristle holder body 7 of each bristle holder assembly 17 passes through the slanting slots 12 of the middle plate 10. The sliding base 8 of each bristle holder body 7 rests on the underlying surface, which is bottom plate 13. There is a vacant intervening space 14 between the top plate 2 and the middle plate 10 of the head section 1. There is another vacant space 15 between middle plate 10 and bottom plate 13 of the head section 1. FIG. 8 shows how the plurality of bristle holder assemblies 17 are positioned inside the head section 1 of the toothbrush 25, with the bristle groups 4 extending through the slanted slots 3 and above the top plate 2.

Figure 9:
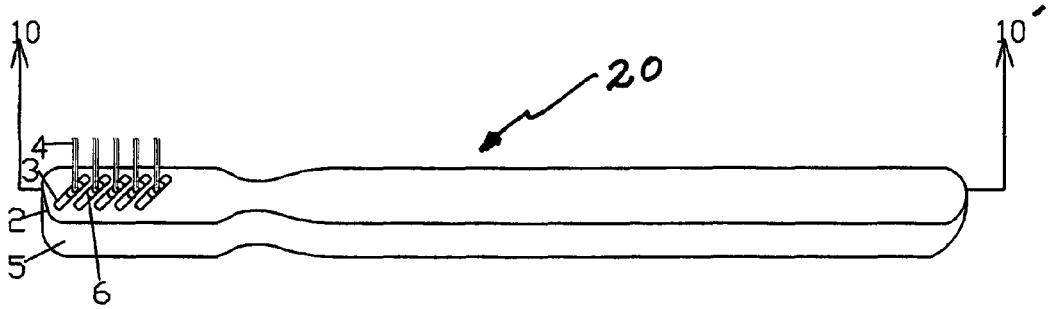
FIG. 9 is another perspective view of a toothbrush of the present invention.
Figure 10:
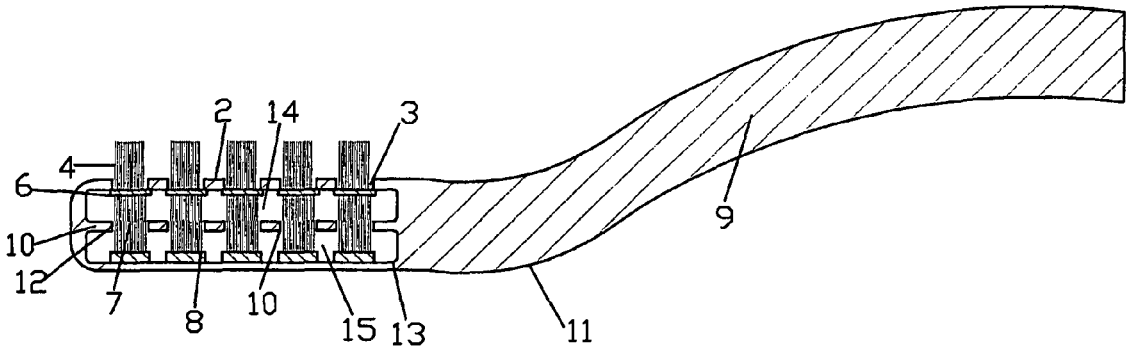
FIG. 10 is a cross section view along line 10-10' of FIG. 9, showing the bristle groups inside the bristle holders.

Referring now to FIG. 9 and FIG. 10, the cross sectional view in FIG. 10 represents the cross-section at the location marked by line 10-10' of FIG. 9. The cross section passes through the center of the bristle holder assemblies 17, and shows how each bristle group 4 is affixed in each bristle holder body 7 to produce the bristle holder assembly 17. The bristle holder body 7 encloses the proximal end of each bristle group 4 tightly. The distal end of each bristle group 4 protrudes from the top end of the bristle holder body 7 and extends out through the linear, slanted slots 3 of the top plate 2 and terminates outside the head section 1 of the toothbrush 25.

Figure 11:
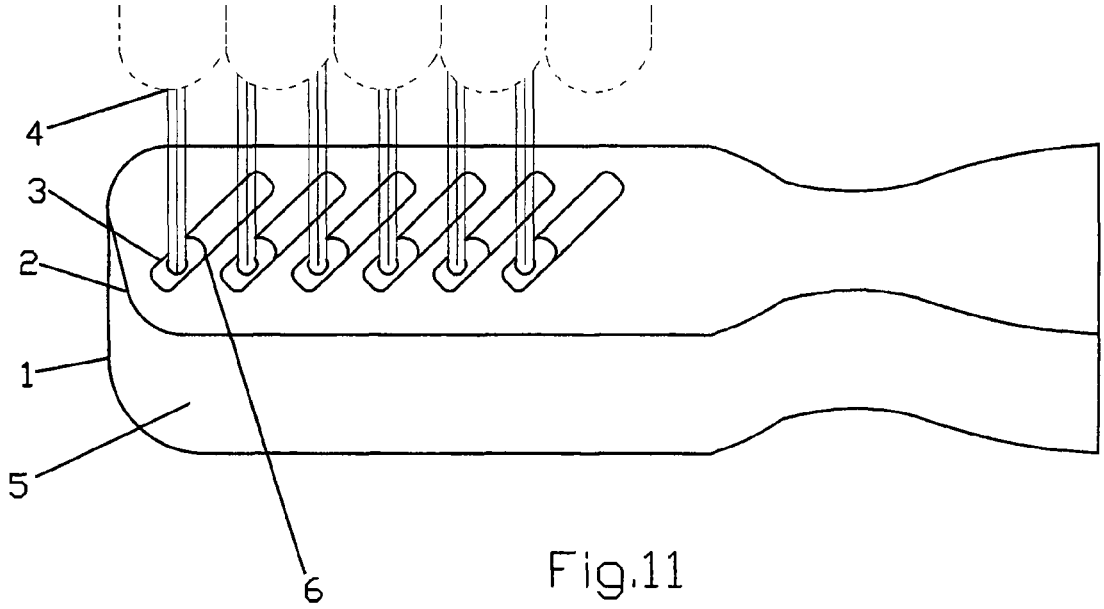
FIG. 11 is a close-up perspective view of the head of a toothbrush of the present invention, showing the bristle groups positioned toward the nearer end of the slanting slots.
Figure 12:
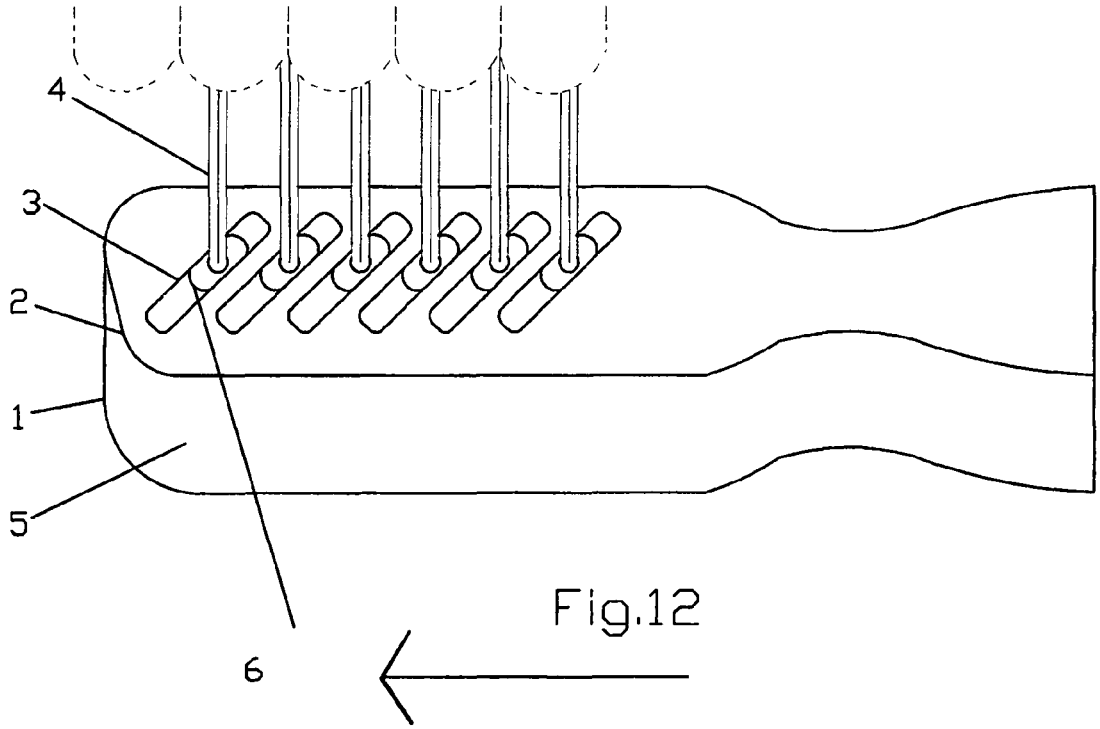
FIG. 12 is a close-up perspective view of the head of a toothbrush of the present invention, showing the bristle groups positioned toward the farther end of the slanting slots.

Referring now to FIG. 11 and FIG. 12, close-up views of the head section 1 of the toothbrush 25 are shown. The figures show the top layer or top plate 2, the plurality of linear, slanted slots 3 through which the plurality of bristle groups 4 pass, with each bristle group 4 being affixed to a single bristle holder body 7, and the stabilizing rim 6, which is visible in the drawings. The stabilizing rim 6 prevents the bristle group 4 from toppling over within the voids 14, 15 of the head section 1 and maintains the bristle groups 4 in an erect orientation, while the bristle holder assemblies 17 slide back and forth inside the constraints of the slanted slots 3. Comparing FIGS. 11 and 12, it is evident that as the toothbrush 25 moves across the surface of the teeth, the independently mobile bristle holder assemblies 17, and the bristle groups 4 contained therein, slide easily in a direction that is essentially perpendicular to the direction of movement of the toothbrush 25. FIGS. 11 and 12 also show an outline of the teeth upon which the bristle groups 4 are moving.

Figure 13:
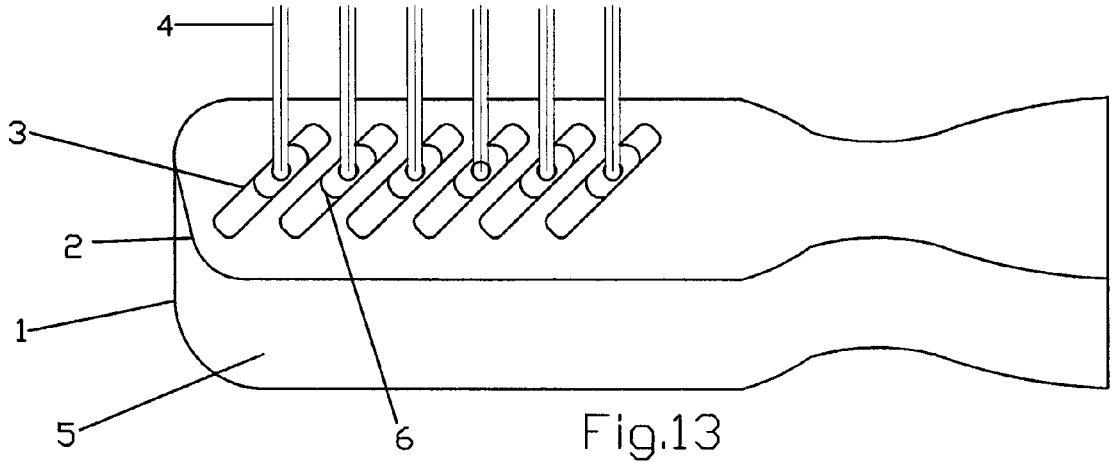
FIG. 13 is a close-up perspective view of the head of a toothbrush of the present invention, showing the bristle groups positioned in the middle of the slanting slots.
Figure 14:
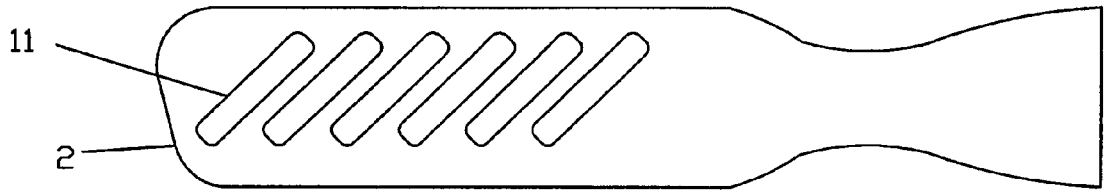
FIG. 14 is a plan view of the top plate of the toothbrush head, showing the adjacent part of the handle.
Figure 15:
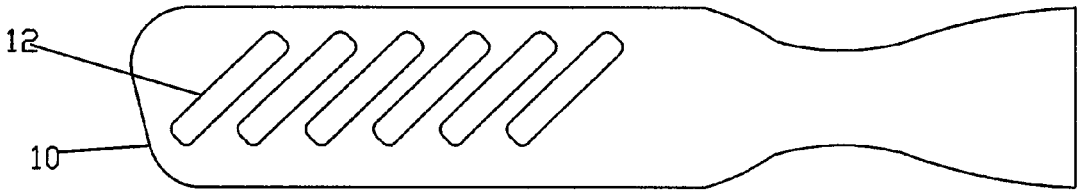
FIG. 15 is a plan view of the middle plate of the toothbrush head, showing the adjacent part of the handle.
Figure 16:
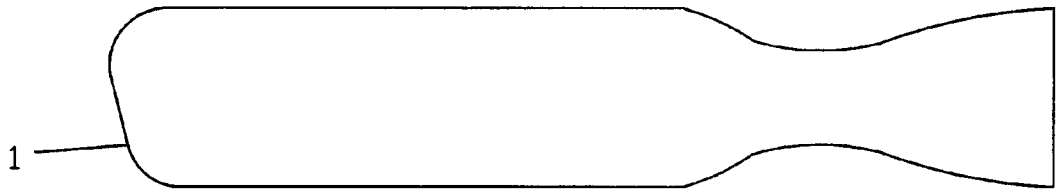
FIG. 16 is a plan view of the bottom plate of the toothbrush head, showing the adjacent part of the handle.

Referring now to FIG. 13, a close up view of the head section 1 of the toothbrush 25 is shown. The top plate 2 contains the slanting slots 3 through which the bristle groups 4 protrude. FIG. 14 shows the top plate 2 alone of the toothbrush head section 1, with the slanting slots 3 contained therein. FIG. 15 shows the middle plate 10, with the slanting slots 12 through which the bristle holder body 7 passes. FIG. 16 shows the bottom plate 13, the layer upon which the bristle holder base 8 rests and slides from side to side.

Figure 17:
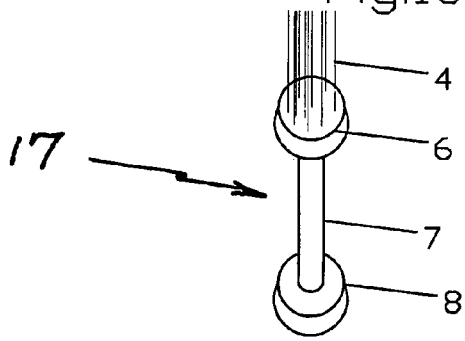
FIG. 17 is a perspective view of the bristle holder and bristle group of the present invention.

Referring now to FIG. 17, the bristle holder assembly 17 includes the bristle group 4, the bristle holder stabilizing rim 6, the bristle holder body 7 and the bristle holder sliding base 8. This entire assembly 17, the bristle holder body 7 with the contained bristle group 4, is present in plurality and is the mobile element in the toothbrush head section 1. The bristle holder assembly 17, with the contained bristle group 4, has independent mobility due to the base 8 of the bristle holder body 7 sliding on the underlying surface of the bottom plate 13 of the toothbrush head section 1.

In an alternative embodiment, the side wall 5 of the head section 1 is not continuous around the head section 1, but does provide support to maintain separation of the top plate 2, the middle plate 10 and the bottom plate 13. With a portion of the side wall 5 of the head section 1 absent, a cleaning route is available for removal of particulate material or fluid that may enter the void spaces 14, 15 within the head section 1, via the slanted slots 3. The open section of the side wall 5 also allows the void spaces 14, 15 within the head section 1 to dry when the toothbrush 25 is not in use.

While the invention has been particularly shown and described with reference to preferred embodiments thereof, it will be understood by those skilled in the art that various changes in form and details may be made therein without departing from the spirit and scope of the invention.

I claim:

1. A toothbrush with independently mobile bristles comprising;

a toothbrush body including a linear handle section connected to a head section via a neck section, the toothbrush body having a long axis there through;

a plurality of individual, linear slots extending from a top surface of the head section and terminating there within, the individual slots oriented at an angle to the long axis of the toothbrush body;

the head section comprising a hollow structure, including a top plate, a bottom plate, and a middle plate positioned in spaced relationship to both the top plate and bottom plate;

a plurality of bristle assemblies, each including a linear bristle holder with a bristle group extending from a first end of the bristle holder, at least one bristle assembly movably positioned in each linear slot of the head section with the bristle group extending exterior to the top surface thereof;

whereby placing the bristle groups of the toothbrush in contact with the teeth of an individual and movement of the toothbrush body in a first direction, parallel with the long axis thereof, causes movement of the bristle assemblies within the slots in a direction essentially perpendicular to the long axis of the toothbrush body, and movement of the toothbrush body in a second direction, opposite the first direction, causes movement of the bristle assemblies within the slots in an opposite direction, also essentially perpendicular to the long axis of the toothbrush body.

2. The toothbrush with independently mobile bristles of claim 1, wherein the plurality of linear slots in the head section is mutually parallel.

3. The toothbrush with independently mobile bristles of claim 1, wherein the top plate and middle plate of the bead section include a plurality of aligned, linear slots in register there through.

4. The toothbrush with independently mobile bristles of claim 3, wherein the linear bristle holder of the bristle assembly is positioned within a linear slot of the middle plate and the bristle group of the bristle assembly is positioned within the aligned linear slot of the top plate.

5. The toothbrush with independently mobile bristles of claim 4, wherein the linear bristle holder includes a stabilizer rim at the first end thereof, from which the bristle group extends, the stabilizer rim positioned interior the hollow head section adjacent the top plate, the stabilizer rim sized to prevent passage of the bristle holder through the linear slot of the top plate.

6. The toothbrush with independently mobile bristles of claim 5, wherein the linear bristle holder includes a base at a second end thereof, the base in slidable contact with the bottom plate of the hollow head section, the base preventing tipping of the linear bristle holder of the bristle assembly.

7. The toothbrush with independently mobile bristles of claim 6, wherein the linear bristle holder, the stabilizer rim and the base of the bristle holder are cylindrical.

8. The toothbrush with independently mobile bristles of claim 1, wherein the head section includes a side wall with at least one aperture therein to provide a cleaning route to the hollow structure of the head section.

9. A toothbrush with independently mobile bristles comprising;

a toothbrush body including a linear handle section connected to a head section via a neck section, the toothbrush body having a long axis there through;

a plurality of mutually parallel, linear slots extending from a top surface of the head section and terminating there within, the mutually parallel slots oriented at an angle to the long axis of the toothbrush body;

the head section comprising a hollow structure, including a top plate, a bottom plate, and a middle plate positioned in spaced relationship to both the top plate and bottom plate;

a plurality of bristle assemblies, each including a linear bristle holder with a bristle group extending from a first end of the bristle holder, at least one bristle assembly movably positioned in each linear slot of the head section with the bristle group extending exterior to the top surface thereof;

whereby placing the bristle groups of the toothbrush in contact with the teeth of an individual and movement of the toothbrush body in a first direction, parallel with the long axis thereof, causes movement of the bristle assemblies within the slots in a direction essentially perpendicular to the long axis of the toothbrush body, and movement of the toothbrush body in a second direction, opposite the first direction, causes movement of the bristle assemblies within the slots in an opposite direction, also essentially perpendicular to the long axis of the toothbrush body.

10. The toothbrush with independently mobile bristles of claim 9, wherein the top plate and middle plate include a plurality of aligned, linear slots in register there through.

11. The toothbrush with independently mobile bristles of claim 10, wherein the linear bristle holder of the bristle assembly is positioned within a linear slot of the middle plate and the bristle group of the bristle assembly is positioned within the aligned linear slot of the top plate.

12. The toothbrush with independently mobile bristles of claim 10, wherein the linear bristle holder includes a stabilizer rim at the first end thereof, from which the bristle group extends, the stabilizer rim positioned interior the hollow head section adjacent the top plate, the stabilizer rim sized to prevent passage of the bristle holder through the linear slot of the top plate.

13. The toothbrush with independently mobile bristles of claim 12, wherein the linear bristle holder includes a base at a second end thereof, the base in slidable contact with the bottom plate of the hollow head section, the base preventing tipping of the linear bristle holder of the bristle assembly.

14. The toothbrush with independently mobile bristles of claim 13, wherein the linear bristle holder, the stabilizer rim and the base of the bristle holder are cylindrical.

15. The toothbrush with independently mobile bristles of claim 9, wherein the head section includes a side wall with at least one aperture therein to provide a cleaning route to the hollow structure of the head section.

16. A toothbrush with independently mobile bristles comprising;

a toothbrush body including a linear handle section connected to a head section via a neck section, the toothbrush body having a long axis there through;

a plurality of mutually parallel, linear slots extending from a top surface of the head section and terminating there within, the mutually parallel slots oriented at an angle to the long axis of the toothbrush body;

the head section comprising a hollow structure, including a top plate, a bottom plate, and a middle plate positioned in spaced relationship to both the top plate and bottom plate, the top plate and middle plate include a plurality of aligned, linear slots in register there through;

a plurality of bristle assemblies, each including a linear bristle holder with a bristle group extending from a first end of the bristle holder, at least one bristle assembly movably positioned in each linear slot of the head section with the linear bristle holder of the bristle assembly positioned within a linear slot of the middle plate and the bristle group of the bristle assembly positioned within the aligned linear slot of the top plate;

whereby placing the bristle groups of the toothbrush in contact with the teeth of an individual and movement of the toothbrush body in a first direction, parallel with the long axis thereof, causes movement of the bristle assemblies within the slots in a direction essentially perpendicular to the long axis of the toothbrush body, and movement of the toothbrush body in a second direction, opposite the first direction, causes movement of the bristle assemblies within the slots in an opposite direction, also essentially perpendicular to the long axis of the toothbrush body.

17. The toothbrush with independently mobile bristles of claim 16, wherein the linear bristle holder includes a stabilizer rim at the first end thereof, from which the bristle group extends, the stabilizer rim positioned interior the hollow head section adjacent the top plate, the stabilizer rim sized to prevent passage of the bristle holder through the linear slot of the top plate.

18. The toothbrush with independently mobile bristles of claim 16, wherein the linear bristle holder includes a base at a second end thereof, the base in slidable contact with the bottom plate of the hollow head section, the base preventing tipping of the linear bristle holder of the bristle assembly.

19. The toothbrush with independently mobile bristles of claim 16, wherein the head section includes a side wall with at least one aperture therein to provide a cleaning route to the hollow structure of the head section.

* * * * *